US007426282B1

(12) United States Patent
Poss

(10) Patent No.: US 7,426,282 B1
(45) Date of Patent: Sep. 16, 2008

(54) HEAD SET SPEAKER AND STEREO PLAYING DEVICE

(75) Inventor: Glen T Poss, 9 Mile Falls, WA (US)

(73) Assignee: US Design & Productions, Kailua, HI (US)

( * ) Notice: Subject to any disclaimer, the term of this patent is extended or adjusted under 35 U.S.C. 154(b) by 2045 days.

(21) Appl. No.: 09/656,470

(22) Filed: Sep. 6, 2000

(51) Int. Cl.
*H04R 25/00* (2006.01)

(52) U.S. Cl. ..... 381/370; 381/371; 381/160; 381/352

(58) Field of Classification Search ..... 381/71.6, 381/370, 371, 373, 374, 160, 352; 379/430, 379/433.02; 455/568, 90, 550
See application file for complete search history.

(56) References Cited

U.S. PATENT DOCUMENTS

| | | | | |
|---|---|---|---|---|
| 4,668,842 | A | 5/1987 | Yokoyama et al. | |
| 5,459,790 | A | 10/1995 | Scofield et al. | |
| 5,617,477 | A | 4/1997 | Boyden | |
| 5,781,638 | A | 7/1998 | Hosaka et al. | |
| 6,134,336 | A * | 10/2000 | Clark | 381/371 |
| 6,385,325 | B1 * | 5/2002 | Nageno et al. | 381/370 |

* cited by examiner

*Primary Examiner*—Huyen Le

(57) ABSTRACT

A head set speaker and stereo radio playing device exhibits improved harmonics and acoustic fidelity. A resilient and flexible headpiece is sized to fit behind the head of the user. Right and left device enclosures are carried by the ends of the headpiece, and are aerodynamic shaped to minimize wind whistle which may result when the head set is worn while moving rapidly. Right and left behind the ear flanges extend downwardly from a position adjacent to the ends of the headpiece, and aid in the positioning of the right and left ear device enclosures. In a typical application, the device enclosures are positioned immediately forward of the user's ears, allowing ambient sound to be heard. A speaker assembly and a removable battery assembly are carried within each device enclosure. The speakers are oriented within the device enclosures with the speaker magnet directed to, and in contact with, the head of the listener. This achieves two interrelated and significant structural and electronic advantages. First, sound fidelity is improved by using sound reflecting walls and baffles to redirect the sound. And second, antenna functionality is improved by attaching an antenna input to the speaker magnet which is in contact with the listener's skin, and there by connecting the listener's body to the antenna. A charging unit is sized to receive both battery assemblies simultaneously. A circuit card carried within one of the device enclosures contains a stereo radio circuit. On/off, volume up, volume down, scan and reset buttons carried by the device enclosures are in electrical communication with the circuit card, and allow control over radio functionality.

10 Claims, 5 Drawing Sheets

HEAD SET SPEAKER AND STEREO PLAYING DEVICE

CROSS-REFERENCES

There are no applications related to this application filed in this or any foreign country.

BACKGROUND

The use of head set speakers is well-known, including those which receive radio transmissions and those which are attached to cassette, CD ROM and MP3 playing devices. Such head set speakers have several advantages over loudspeaker systems. They reduce interference with other people, provide high fidelity, and tend to minimize the interference of background noise present in the listening environment.

Unfortunately, known head set speakers have a tendency to prevent the wearer from hearing ambient sound. For example, where a runner is wearing a head set, the sound of the approach of an on-coming car may go unnoticed.

Where a typical head set is equipped with a radio tuner, it is generally the case that reception is at times markedly worse than larger receivers with superior antennas. In an effort to maximize portability and to minimize size, designers have generally failed to optimize antenna functionality. As a result, the antenna is inadequate for reception in many conditions.

Similarly, in part due to their smaller size, some of the speakers used in the construction of head sets are not as responsive, do not have the range and tend to have greater distortion than speakers constructed without regard to size.

What is needed is a head set having a built-in tuner, superior speaker fidelity and a more effective antenna design.

SUMMARY

The present invention is directed to an apparatus that satisfies the above needs. A novel head speaker and stereo playing device is disclosed that has a built-in tuner, superior speaker fidelity and a more effective antenna design. Versions of the invention are adapted for use with cassette, CD, MP3 and other technologies. The head set speaker of the present invention provides some or all of the following structures.

(A) A headpiece is both resilient and flexible, and is designed to go behind the head, typically at approximately ear level. A flexible arch adjusts for the user's head size. Left and right upper curves extend over the ears during use. Left and right ends of the headpiece support left and right ear device enclosures, respectively.

(B) Left and right ear flanges extend downwardly from a rear portion of the left and right upper curves. During use, the ear flanges are located behind the ear of the user, in a manner similar to the stem of eye glasses. The ear flanges tend to prevent the headpiece from moving too far forward, particularly where the headpiece is sized to accommodate a larger wearer.

(C) Left and right ear device enclosures carry the battery assemblies, circuit boards and speaker assemblies. In a preferred embodiment, an aerodynamic front end and a rounded back end of each ear device enclosure results in lower wind resistance and wind interaction. This is particularly important for runners, bicyclist and in-line skaters, and results in greater acoustic fidelity, due to the reduction in the sounds of air moving.

(D) A battery assembly is carried within each ear device enclosure. In a preferred embodiment, each battery assembly includes a somewhat heart-shaped enclosure which contains two batteries. The battery assembly enclosure may be detached from the ear device enclosure, and inserted into a charging unit for recharging.

(E) A circuit board is carried within one of the ear device enclosures. A preferred circuit board includes a radio signal processing integrated circuit (IC), a volume controlling IC and a power amplification IC. Input to the circuit board includes an on/off switch, volume up and down switches, a frequency scan switch and a reset switch. An antenna lead, in communication with the appropriate input on the radio signal processing IC, is attached to at least one speaker magnet.

(F) A speaker assembly is present in each ear device enclosure. Each speaker assembly includes a speaker directed outwardly, away from the user's ear. A sound reflecting wall, located in front of each speaker, reflects the sound from the speaker toward the user's ear. The speaker magnet of each speaker assembly extends through a hole defined in the ear device enclosure, allowing contact with the listener's skin.

(G) A charging unit includes a base having appropriate terminal posts and retaining clips to receive and charge the battery assemblies from each ear device enclosure.

It is therefore a primary advantage of the present invention to provide a novel head set speaker and stereo radio playing device wherein the speaker cone is oriented away from the user's ear and sound is reflected back to the user.

Another advantage of the present invention is to provide a novel head set speaker and stereo radio playing device wherein an antenna input to the tuning circuit is connected to the speaker magnet and wherein the speaker magnet extends from the ear device enclosure to allow contact with the user's skin, thereby allowing the body of the user to form a part of the antenna.

Another advantage of the present invention is to provide a novel head set speaker and stereo radio playing device wherein left and right ear device enclosures have an aerodynamically curved front end and a rounded back end for minimizing air whistle when the user is moving rapidly, such as on a bicycle or in-line skates.

A still further advantage of the present invention is to provide a novel head set speaker and stereo radio playing device having a behind-the-neck headpiece having upper curves which extend over each ear and ear flanges which locate speakers forward of the ears in a manner which allows some ambient sound to be heard.

Other objectives, advantages and novel features of the invention will become apparent to those skilled in the art upon examination of the specification and the accompanying drawings.

DRAWINGS

These and other features, aspects, and advantages of the present invention will become better understood with regard to the following description, appended claims, and accompanying drawings where:

Figure 1:
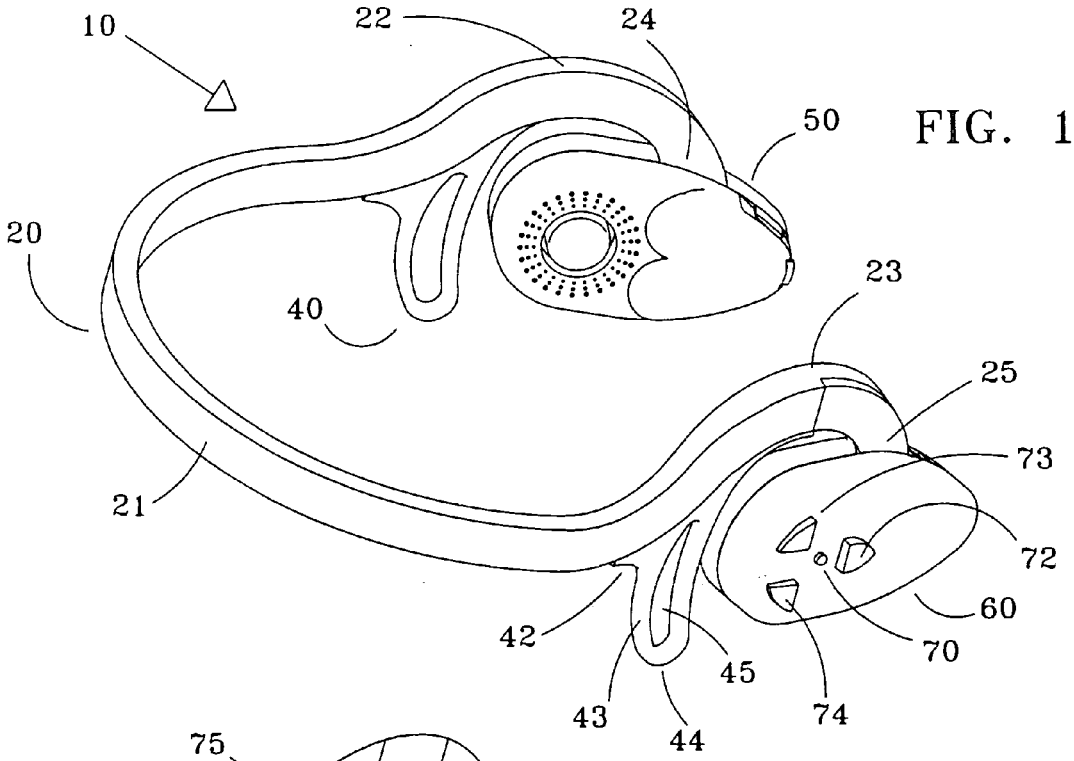
FIG. 1 is an isometric view of a version of the head set speaker and stereo radio playing device, oriented as if worn by a person looking to the right, with the headpiece behind the head of the wearer, and the perspective taken from above and behind the right ear.

Referring in to FIG. 1, a head set speaker and stereo playing device 10 constructed in accordance with the principles of the invention is seen. The stereo playing device is adapted for use with radio, cassette, CD ROM, MP3 or other source of musical information. A resilient and flexible headpiece 20 is sized to fit behind the head of the user. Right and left device enclosures 50, 60 are carried by the ends of the headpiece, and are aerodynamic shaped to minimize wind whistle which may result when the head set is worn while moving rapidly. Right and left behind the ear flanges 40 extend downwardly from a position adjacent to the ends of the headpiece, and aid in the positioning of the right and left ear device enclosures. In a typical application, the device enclosures are positioned immediately forward of the user's ears, allowing ambient sound to be heard. A speaker assembly 120 and a removable battery assembly 80 are carried within each device enclosure. The speakers are oriented within the device enclosures 50, 60 with the speaker magnet directed to, and in contact with, the head of the listener. This achieves two interrelated and significant structural and electronic advantages. First, sound fidelity is improved by using sound reflecting walls and baffles to redirect the sound. And second, antenna functionality is improved by attaching an antenna input to the speaker magnet which is in contact with the listener's skin, and there by connecting the listener's body to the antenna. A charging unit 140 is sized to receive both battery assemblies simultaneously. A circuit card 100, carried within one of the device enclosures contains a stereo radio circuit. On/off, volume up, volume down, scan and reset buttons carried by the device enclosures are in electrical communication with the circuit card, and allow control over radio functionality.

A headpiece 20 supports the right and left device enclosures in a position immediately forward of the user's ears. As seen particularly in FIGS. 1 and 2, the headpiece is oriented substantially horizontally during use, and wraps about the back of the user's head, at approximately the ear level, just above the collar line.

A preferred headpiece includes an arch 21, made of a flexible and resilient material. Due to the characteristics of the material, the headpiece biases an inner half piece 61 of each device enclosure gently against the user's head, and additionally, adjusts to fit the head of larger and smaller users.

Wires connecting the left and right device enclosures 50, 60 pass through an interior channel defined within the headpiece 20. The wires provide communication between the switches and speakers carried within those enclosures.

The left and right ends of the flexible arch 21 carry left and right over-the-ear upper curves 22, 23. The shape of the upper curves correspond to the head shape and ear location of the average user. As seen particularly in FIGS. 1-3, the upper curve prevents contact between the headpiece 20 and the user's ear by touching the user's head at a position higher than the user's ear.

Left and right ends 24, 25 of the headpiece support left and right device enclosures, 50, 60 respectively.

Figure 2:
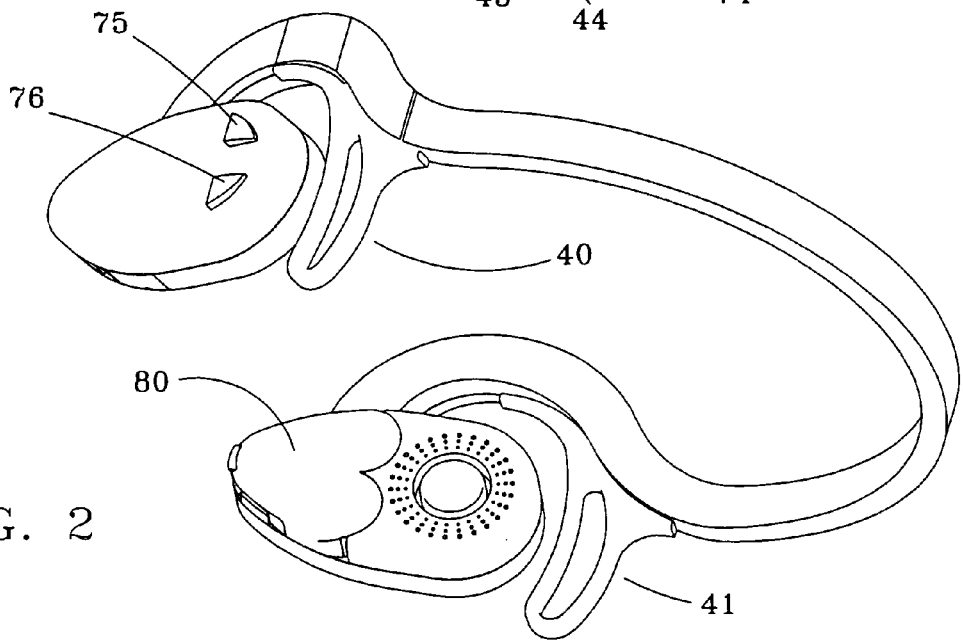
FIG. 2 is an isometric view of the head set speaker and stereo radio playing device of FIG. 1, oriented as if worn by a person looking to the left, with the headpiece behind the head of the wearer, and the perspective taken from below and behind the left ear.
Figure 3:
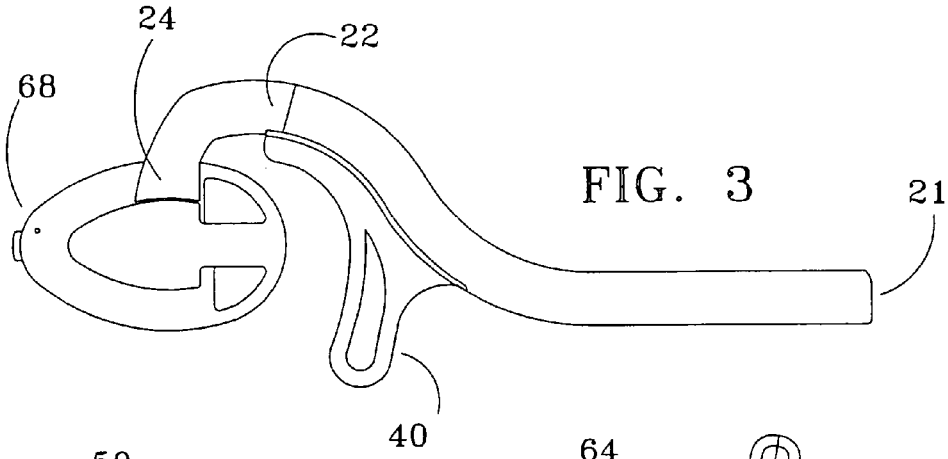
FIG. 3 is an orthographic view of the head set of FIG. 1, oriented as if worn by a person looking to the left.
Figure 4:
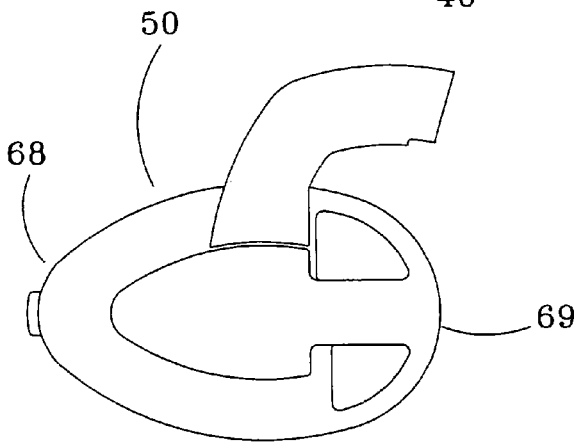
FIG. 4 is an enlarged orthographic view of the outside surface of the left ear enclosure of FIG. 3.
Figure 6:
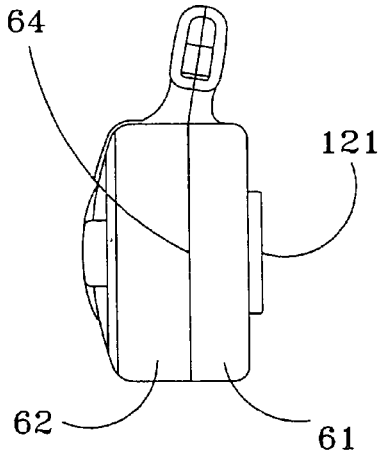
FIG. 6 is an orthographic view of the rear surface of the left ear enclosure.
Figure 5:
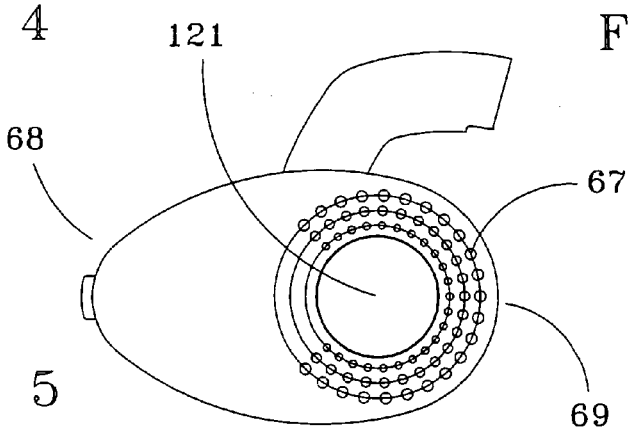
FIG. 5 is an enlarged orthographic view of the inside surface of the right ear enclosure.

Referring particularly to FIGS. 1-3, mirror image left and right ear flanges 40, 41 extend downwardly from a rear portion of the left and right upper curves 22, 23, in the area of confluence of the upper curves and the ends of the flexible arch 21. During use, the ear flanges 40, 41 are located behind the left and right ears of the user, in a manner similar to the stem of eyeglasses. The ear flanges tend to prevent the headpiece from moving too far forward, particularly where the headpiece is sized to accommodate a larger wearer.

While a number of configurations are consistent with the structure and functionality of the ear flanges shown in FIGS. 1-3, a typical ear flange includes a base 42 from which extends a loop 43 having a downwardly oriented tip 44. A passage 45 may be defined through the loop 43.

Left and right ear device enclosures 50, 60 enclose the battery assemblies 80, circuit boards 100 and speaker assemblies 120. In a preferred embodiment, the enclosures are made of an inner half piece 61 and an outer half piece 62, the perimeters 64 of which are snapped together after the enclosed assemblies are installed. Optionally, interlocking edges 65 may be used to result in a more secure connection.

It is a feature of the preferred embodiment that the friction of the air flow around the device enclosures is minimized due to the shape of the enclosure. This minimization is particularly important for runners, bicyclist and in-line skaters, and results in greater acoustic fidelity, due to the advantageous reduction in the whistling sounds of air moving.

An aerodynamic front end 68 has a radius that is less than the radius of the rounded back end 69. In combination, the perimeter of the enclosure is substantially tear drop shaped. The tear drop shape contributes to lower air friction and air resistance. These factors in turn contribute to less background noise and higher fidelity.

Because the user's ear is typically slightly behind the rounded back end 69, the orientation of the enclosures with the end 68 having the smaller radius forward of the end 69 having the larger radius is preferred. With this configuration, when the enclosures are rapidly moving through air, each of the user's ears is somewhat sheltered immediately behind the rounded back end 69 of each of the enclosures. Air streams are diverted around the user's ears, or the air streams are slowed before contact with the ear.

Figure 9:
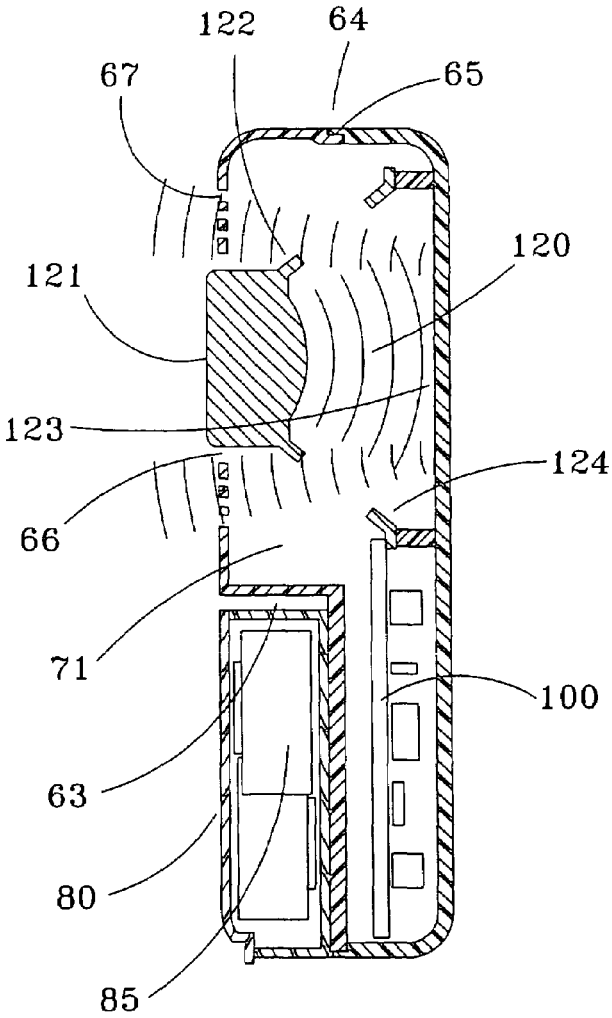
FIG. 9 is a cross-sectional view of a second version of an ear enclosure.
Figure 7:
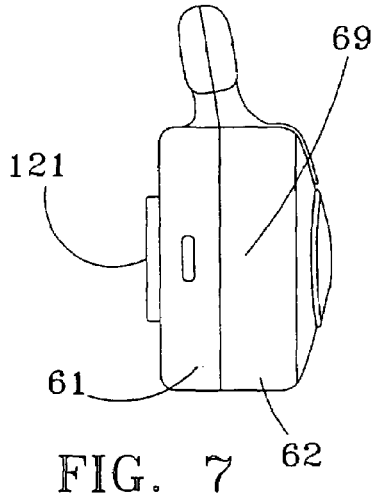
FIG. 7 is an orthographic view of the front surface of the left ear enclosure.
Figure 8:
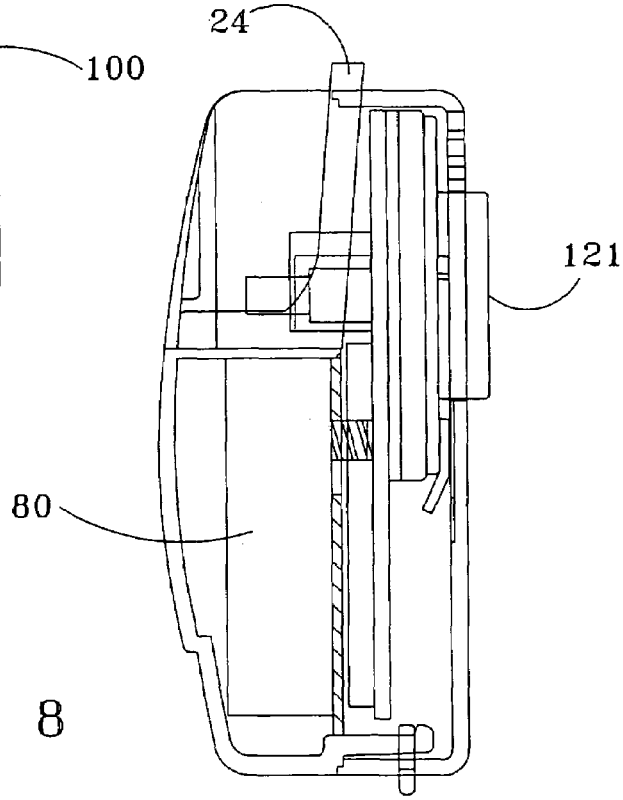
FIG. 8 is a cross-sectional view of a first version of an ear enclosure.

A battery unit unit indentation 63 on each enclosure 50, 60 is sized to accept a battery assembly 80. The battery indentation may be on the inside, next to the user's ear, as seen in FIG. 9, or may be on the outside, opposite the user's ear, as seen in FIG. 8. In either case, the battery indentation allows the enclosures 50, 60 to fit flush with the outer surface of the device enclosure.

An opening 66, through which the speaker magnet extends, is defined in the inner half piece 61 of each enclosure. Arrayed about the opening 66 is a plurality of holes 67 for allowing the passage of sound from the interior 71 of the enclosure.

Referring to FIG. 1, a number of holes and buttons supported by the right enclosure may be seen. An LED hole 70 allows a power-on indictor LED 104 to be seen during operation. An on/off button 72 and associated hole allows the user to access the on/off switch 106 on the circuit board 100. Similarly, a volume up button 73 and a volume down button 74 extend through their associated holes defined in the right enclosure, and allow the user to manipulate the volume up and volume down switches 107, 108 on the circuit board 100.

Referring to FIG. 2, a number of holes and buttons supported by the left enclosure may be seen. A scan button 75 and a reset button 76 extend through their associated holes defined in the left enclosure.

Figure 12:
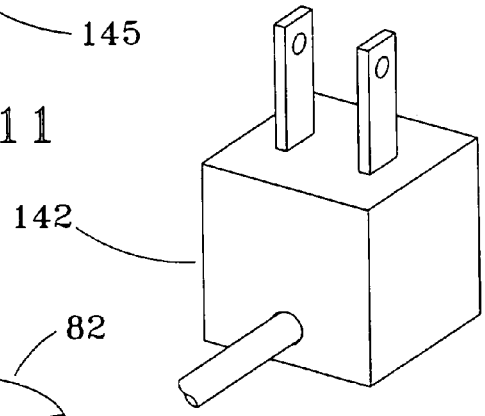
FIG. 12 is an isometric view of the AC plug unit associated with the battery charging unit.
Figure 10:
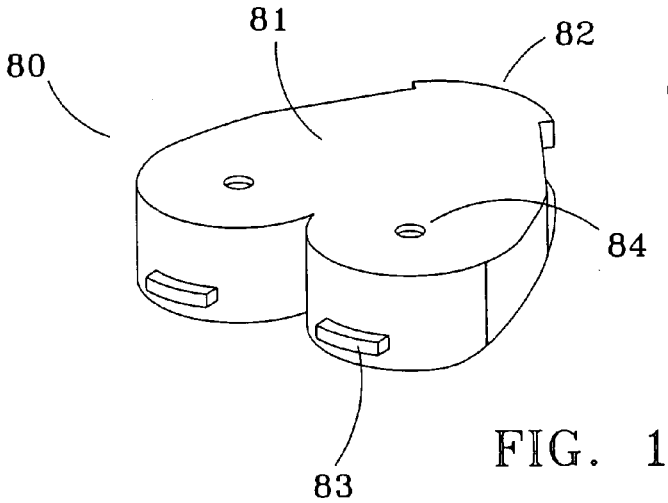
FIG. 10 is an isometric view of a version of the battery assembly.

As seen particularly in FIGS. 8, 10 and 12, during periods of operation, a battery assembly 80 is carried within each ear device enclosure. During operation, the left and right battery assemblies jointly supply the power required by the circuit board 100 and speaker assemblies 120. When required, both battery assemblies may be detached from the ear device enclosure and inserted into the base unit 141 of the charging assembly 140 where they may be completely recharged.

In a preferred embodiment, each battery assembly includes a somewhat heart-shaped enclosure 81 which contains two batteries 85. As seen best in FIGS. 1 and 2, the heart-like shape conforms to the shape of the aerodynamic front end 68 of the enclosure. The enclosure may provide a first fastening device such as locking tab 82 which engages the enclosures 50, 60 when in use.

Figure 11:
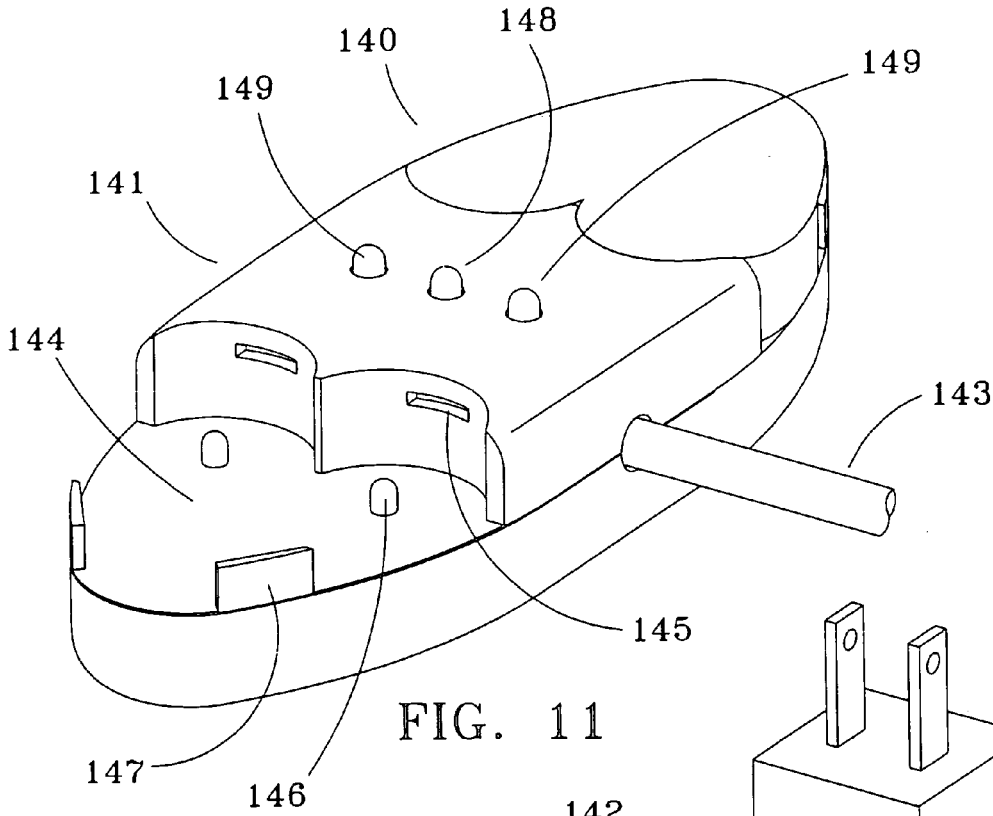
FIG. 11 is an isometric view of a version of the battery charging unit.

Referring particularly to FIGS. 10 and 11, a second fastening device such as the two alignment tabs 83 on each battery assembly engage recesses 145 defined in the charging unit 140. Terminal holes 84 defined in the enclosure 81 allow the terminal posts 146 of the charging unit to electrically access the batteries during the recharging period, and allow similar posts on the circuit board to access the batteries during operation.

Figure 13:
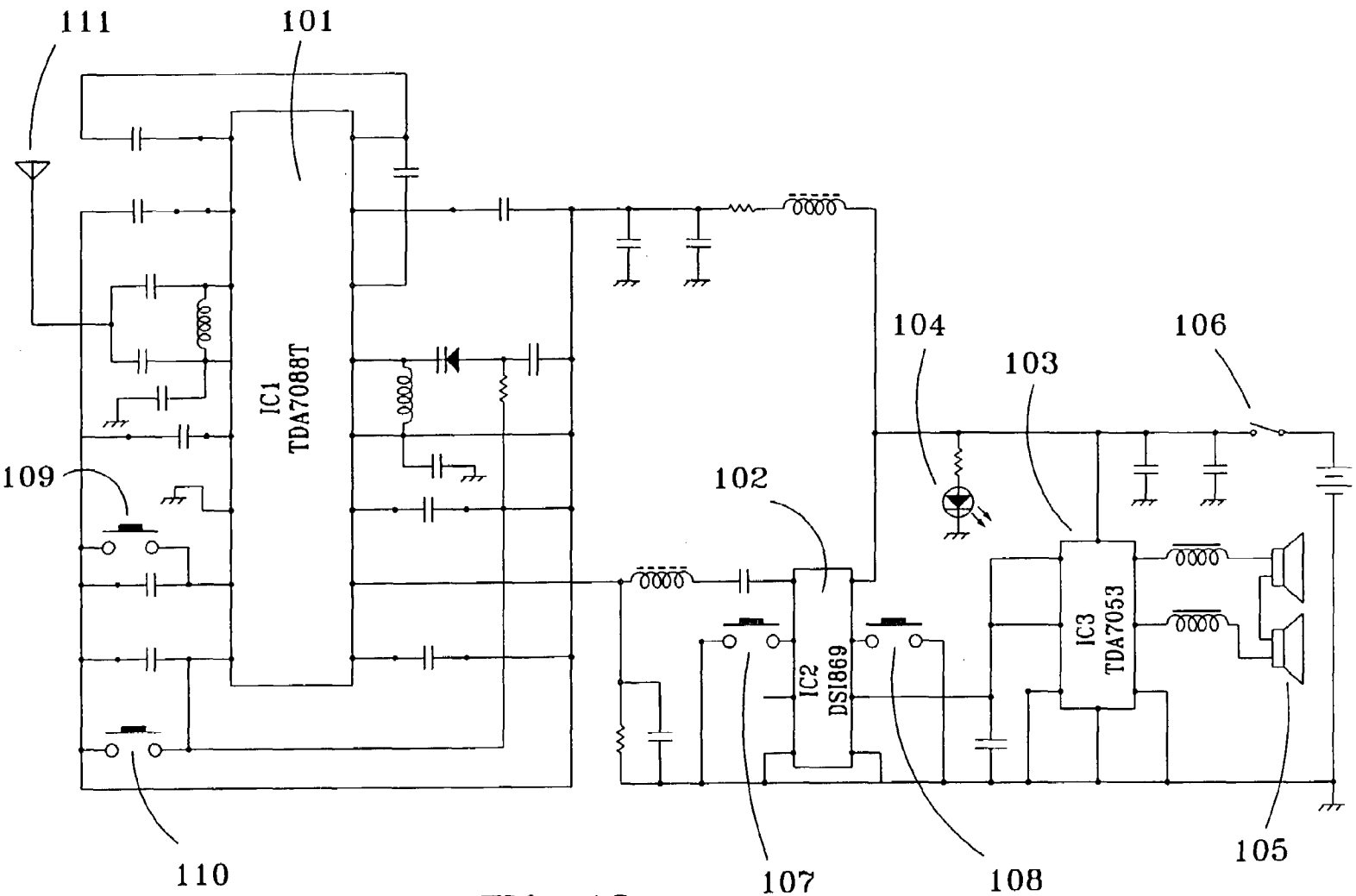
FIG. 13 is a circuit diagram of a version of the head set speaker and stereo radio playing device.

As seen in FIGS. 9 and 10, a circuit board 100 is carried within one of the ear device enclosures 50, 60. Alternatively, where space is too constrained, the circuit board may be divided, and a portion carried by each ear device enclosure. The stereo playing device 10 is adapted for use with radio, cassette, CD ROM, MP3 or other source of musical information, and therefore some variation of the circuit may be made to adapt to these applications. Referring additionally to FIG. 13, the details of a preferred version of the circuitry using FM radio may be understood. A preferred circuit board includes a radio signal processing integrated circuit (IC) 101, a volume controlling IC 102 and a power amplification IC 103. Referring to FIG. 13, in very general terms, the radio signal processing and volume controlling ICs provide input to the power amplification IC. That is, radio signal information and volume degree information are communicated to IC 103 by ICs 101 and 102, respectively. Input to the circuit board includes several switches. An on/off switch 106 is in communication with the source of battery power. Volume up and down switches 107, 108, are in communication with the volume controlling IC 102. A frequency scan switch 109 and a reset switch 110 are in communication with the radio signal processing circuit. As seen in FIG. 13, a power on LED 104 is lit during operation due to its position in the circuit adjacent to the on/off switch and battery.

The scan 109 and reset 110 switches are input into the radio frequency tuning and processing IC 101. By manipulation of these switches the user is able to control the radio station selection in a known manner.

Referring primarily to FIG. 13, a first end of an antenna lead 111 is in communication with the appropriate input on the radio signal processing IC, while a second end is attached to at least one speaker magnet 121. As a result, one or both speaker magnets is electrically attached to the antenna input of the radio signal processing IC. Since both speakers magnets extend through holes 66, defined in the inside of each enclosure, both speaker magnets come into contact with the skin of the listener during operation. Due to this contact, some electrical information is passed from the body of the listener into the antenna input on the signal processing IC. This results in the listener's body acting as part of the antenna during operation.

The volume up and down switches 107, 108, are connected to the volume controlling IC 102, which also receives input from the radio signal processing IC 101. The output of the volume controlling IC is an input to the amplification IC 103, which drives the speakers 105.

Referring particularly to FIGS. 9 and 13, a speaker assembly 120 is present in each ear device enclosure 50, 60. Each speaker assembly includes the speaker 105, having a magnet 121 and cone 122. Because the speaker is oriented outwardly, away from the listener's ears, a sound reflecting wall 123 and baffles 124 redirect the sound for passage from the enclosures 50, 60 through the array of holes 67.

As seen in the cross-section view of FIG. 9, the speaker magnet 121 of each speaker is directed toward the listener. The rear surface of each speaker magnet 121 extends through a hole 66 defined in the ear device enclosure. During operation, physical contact between the rear surface of each speaker magnet and the listener's skin provides electrical communication between the listener's body and the antenna input on the radio signal processing IC 101. As a result, the size and typically vertical orientation of the listener helps to contribute to the clarity of the radio transmission signal received.

Continuing to refer to the cross-sectional view of FIG. 9, a sound reflecting wall 123 is located on an inside surface of the outer half piece 62 of the enclosure, in front of the cone 122 of each speaker. The sound reflecting wall may have one or more baffles 124 to reflect the sound from the speaker toward the user's ear. The sound waves produced by the cone 122 are therefore reflected by the wall 123 and baffles 124, allowing them to exit from the enclosures through the array of holes 67 adjacent to the user's ear.

A charging unit 140 includes a base unit 141 adapted to receive and charge two battery assemblies 80 and a plug unit 142 which is adapted for installation in an AC outlet, and which supplies low-voltage, low-amperage direct current to the base unit. A cord 143 connects the base unit to the plug unit.

Referring particularly to FIG. 11, a preferred version of the base unit 141 is seen. Left and right recesses 144 are sized to receive the corresponding battery assemblies 80. Alignment tab recesses 145 are sized to engage the alignment tabs 83 of each battery assembly. Terminal posts 146 insert into the terminal holes 84 of each battery assembly. Retaining clips 147 engage the locking tab 82 of each battery assembly, preventing unwanted movement during the charging process.

Continuing to refer to FIG. 11, it can be seen that a centrally located power-on LED 148 gives the user an indication that the charging unit is plugged into an active AC outlet. Left and right battery charging LEDs 149 indicate that the respective battery assembly is currently being charged.

The previously described versions of the present invention have many advantages, including a primary advantage of providing a novel head set speaker and stereo radio playing device wherein the speaker cone is oriented away from the user's ear and sound is reflected back to the user.

Another advantage of the present invention is to provide a novel head set speaker and stereo radio playing device wherein an antenna input to the tuning circuit is connected to the speaker magnet and wherein the speaker magnet extends from the ear device enclosure to allow contact with the user's skin, thereby allowing the body of the user to form a part of the antenna.

Another advantage of the present invention is to provide a novel head set speaker and stereo radio playing device wherein left and right ear device enclosures have an aerodynamically curved front end and a rounded back end for minimizing air whistle when the user is moving rapidly, such as on a bicycle or in-line skates.

A still further advantage of the present invention is to provide a novel head set speaker and stereo radio playing device having a behind-the-neck headpiece having upper curves which extend over each ear and ear flanges which locate speakers forward of the ears in a manner which allows some ambient sound to be heard.

Although the present invention has been described in considerable detail and with reference to certain preferred versions, other versions are possible. For example, while a preferred headpiece, ear flanges and ear device enclosures have been disclosed, a similar configuration could achieve some of the same advantages. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A head set speaker and stereo playing device for use by a listener, comprising:

(A) a resilient and flexible headpiece;

(B) left and right ear device enclosures;

(C) a circuit board, carried within one of the ear device enclosures; and (D) a speaker assembly, carried within each ear device enclosure, each speaker assembly comprising:

(a) a speaker directed outwardly, with a cone directed toward an outer half piece of the ear device enclosure;

(b) a sound reflecting wall, located in front of each speaker, reflects the sound from the speaker toward the user's ear; and (c) a speaker magnet extending through a hole defined in the ear device enclosure, whereby the speaker magnet is in contact with the listener when in use.

2. The head set speaker and stereo playing device of claim 1, wherein the resilient and flexible headpiece comprises:

(A) a flexible arch sized to go behind the listener's head; and (B) left and right upper curves sized to go over the listener's ears, terminating in left and right ends.

3. The head set speaker and stereo playing device of claim 2, additionally comprising left and right ear flanges, extending downwardly from a rear portion of the left and right upper curves.

4. The head set speaker and stereo playing device of claim 2, wherein each ear device enclosure comprises an inner half piece mated to the outer half piece, and whereby the combined inner and outer half pieces define an aerodynamic front end and a rounded back end, wherein the aerodynamic front end has a radius that is less than the radius of the rounded back end.

5. The head set speaker and stereo playing device of claim 4 additionally comprising left and right battery assemblies, removably carried within the left and right ear device enclosures, each battery assembly comprising:

(A) a heart-shaped enclosure containing two batteries;

(B) first fastening means, carried by the heart-shaped enclosure, for attachment of the battery assembly to each ear device enclosure; and (C) second fastening means, carried by the heart-shaped enclosure, for attachment of the battery assembly to a charging unit.

6. The head set speaker and stereo playing device of claim 5, wherein the charging unit, comprises:

(A) a base unit, comprising two pair of terminal post means for charging the left and right battery assemblies and retaining clip means to engage the first fastening means; and (B) a plug unit, in electrical communication with the base unit.

7. The head set speaker and stereo playing device of claim 1, wherein each ear device enclosure comprises an inner half piece mated to the outer half piece, and whereby the combined inner and outer half pieces define an aerodynamic front end and a rounded back end, wherein the aerodynamic front end has a radius that is less than the radius of the rounded back end.

8. The head set speaker and stereo playing device of claim 1, additionally comprising left and right battery assemblies, removably carried within the left and right ear device enclosures, each battery assembly comprising:

(A) a heart-shaped enclosure containing two batteries;

(B) first fastening means, carried by the heart-shaped enclosure, for attachment of the battery assembly to each ear device enclosure; and (C) second fastening means, carried by the heart-shaped enclosure, for attachment of the battery assembly to a charging unit.

9. The head set speaker and stereo playing device of claim 1, wherein the circuit board comprises:

(A) a radio signal processing circuit;

(B) a volume controlling circuit;

(C) a power amplification IC, receiving radio signal information from the radio signal processing circuit and volume level information from the volume controlling circuit;

(D) an on/off switch in electrical communication with the battery assembly;

(E) volume up and down switches in communication with the volume controlling circuit;

(F) a frequency scan switch and a reset switch in communication with the radio signal processing circuit; and (G) an antenna lead, in electrical communication with the radio signal processing IC.

10. A head set speaker and stereo playing device for use by a listener, comprising:

(A) a resilient and flexible headpiece, comprising:

(a) a flexible arch sized to go behind the listener's head; and (b) left and right upper curves sized to go over the listener's ears, terminating in left and right ends;

(B) left and right ear flanges, extending downwardly from a rear portion of the left and right upper curves;

(C) left and right ear device enclosures, each ear device enclosure comprising an inner half piece mated to an outer half piece, whereby the combined inner and outer half pieces define an aerodynamic front end and a rounded back end, wherein the aerodynamic front end has a radius that is less than the radius of the rounded back end;

(D) left and right battery assemblies, removably carried within the left and right ear device enclosures, each battery assembly comprising:

(a) a heart-shaped enclosure containing two batteries;

(b) first fastening means, carried by the heart-shaped enclosure, for attachment of the battery assembly to each ear device enclosure; and (c) second fastening means, carried by the heart-shaped enclosure, for attachment of the battery assembly to a charging unit;

(E) a circuit board, carried within one of the ear device enclosures, comprising:

(a) a radio signal processing circuit;

(b) a volume controlling circuit;

(c) a power amplification IC, receiving radio signal information from the radio signal processing circuit and volume level information from the volume controlling circuit;

(d) an on/off switch in electrical communication with the battery assembly;

(e) volume up and down switches in communication with the volume controlling circuit;

(f) a frequency scan switch and a reset switch in communication with the radio signal processing circuit; and (g) an antenna lead, in electrical communication with the radio signal processing IC;

(F) a speaker assembly, carried within each ear device enclosure, each speaker assembly comprising:

(a) a speaker directed outwardly, with a cone directed toward the outer half piece of the ear device enclosure;

(b) a sound reflecting wall, located in front of each speaker, reflects the sound from the speaker toward the user's ear; and (c) a speaker magnet extending through a hole defined in the inner half piece of the ear device enclosure; and (G) the charging unit, comprising:

(a) a base unit, comprising two pair of terminal post means for charging the left and right battery assemblies and retaining clip means to engage the first fastening means; and (b) a plug unit, in electrical communication with the base unit.

* * * * *